United States Patent [19]

Young-Koo

[11] Patent Number: 4,491,425

[45] Date of Patent: Jan. 1, 1985

[54] MULTI-ORIENTABLE CLOCK AND STAND

[75] Inventor: Ahn Young-Koo, Pusan, Rep. of Korea

[73] Assignee: Jeco Precision Co., Ltd., Pusan, Rep. of Korea

[21] Appl. No.: 538,015

[22] Filed: Sep. 30, 1983

[30] Foreign Application Priority Data

Feb. 11, 1982 [KR] Rep. of Korea ..... 83-1232

[51] Int. Cl.[3] ..... G04B 37/00

[52] U.S. Cl. ..... 368/317; 368/316; 248/116; 248/114

[58] Field of Search ..... 368/316, 317; 248/114–116, 634; 211/89

[56] References Cited

U.S. PATENT DOCUMENTS

| | | | |
|---|---|---|---|
| 1,021,045 | 3/1912 | Hummel | 248/115 |
| 1,611,568 | 12/1926 | Standow | 368/316 |
| 3,967,346 | 7/1976 | Young, Jr. | 211/89 |
| 4,290,575 | 9/1981 | Swartwout | 211/89 |
| 4,362,402 | 12/1982 | Kallinke et al. | 248/116 |

*Primary Examiner*—Bernard Roskoski

*Attorney, Agent, or Firm*—Armstrong, Nikaido, Marmelstein & Kubovcik

[57] ABSTRACT

A combination clock and stand wherein the clock includes a cylindrical clock body with outer circumferential cylinder coaxially surrounding the same. On an inner surface of the outer cylinder is a plurality of axially extending pairs of spaced-apart, parallel projections extending radially into a channel defined between the cylinder and the clock body. The clock body has a plurality of openings therein, each opening extending radially inwardly between one pair of parallel projections and being spaced inwardly of the back of the clock body. The stand includes base portion having a pair of parallel elastic latches thereon. Each of the latches has a front end and a rear end and is mounted at its rear end on the base portion. The latches are sized to flank one of the pairs of projections. A pair of flexible curved pieces are attached at their front ends to the front ends of one of the latches. The curved pieces and the latches are sized to fit slideably into the channel. Multiple jaw members connect the rear ends of the curved pieces and are adapted to engage with one of the openings of the clock body. An adhesive pad can be fixed to the bottom of the base portion of the stand to enable it to be attached to any horizontal or vertical surface.

2 Claims, 6 Drawing Figures

MULTI-ORIENTABLE CLOCK AND STAND

BACKGROUND OF THE INVENTION

The present invention relates to a combination of a clock and stand, and, more particularly, to clock and stand combination wherein the stand may be attached to any flat horizontal or vertical surface with the clock being arrangeable to have the face thereof in its proper orientation.

Generally, desk clocks have a stand which enable them to be set on a flat horizontal surface with the clock on the upward side thereof. There desk clocks can be permanently or detachably fitted to such a stand. However, a clock and stand arrangement of this type can only be used on the top of a flat, horizontal surface or else the clock will be incorrectly oriented.

OBJECTS AND SUMMARY OF THE INVENTION

It is an object of the present invention to provide a clock and stand combination in which the stand may be placed on any flat horizontal or vertical surface while the clock remains correctly oriented.

It is a further object of the present invention to provide a clock and stand arrangement wherein the clock is detachable from the stand.

It is a still further object of the present invention to provide a clock and stand combination which is easily manufactured and simple to use.

The above and other objects are obtained in a combination clock and stand which includes a clock having a cylindrical clock body, and an outer circumferential cylinder coaxially surrounding and being attached to the clock body defining a channel therebetween. The outer cylinder has an inner surface and a plurality of axially extending pairs of spaced-apart parallel projections. The projections extend radially into the channel. The clock body has on an outer surface thereof a plurality of openings. Each opening extends radially inwardly between one pair of parallel projections. Each opening is spaced inwardly of the back of the clock body. A stand is included which has a base portion with a pair of parallel elastic latches, each having a front end and rear end and being mounted on its rear end on the base portion. The latches are sized to flank one of the pairs of projections. Further, a pair of flexible curved pieces, each having a front end and rear end are attached at their front ends to the front ends of one of the latches. The curved pieces and the latches are sized to fit slideably in the channel. Multiple jaw members connect the rear ends of the curved pieces and are adapted to engage with one of the openings in the clock body. A means for attaching the base portion to a desired surface is provided. The means for attaching can comprise adhesive of pads fixed to the bottom of the base portion.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF A PREFERRED EMBODIMENT

Figure 1:
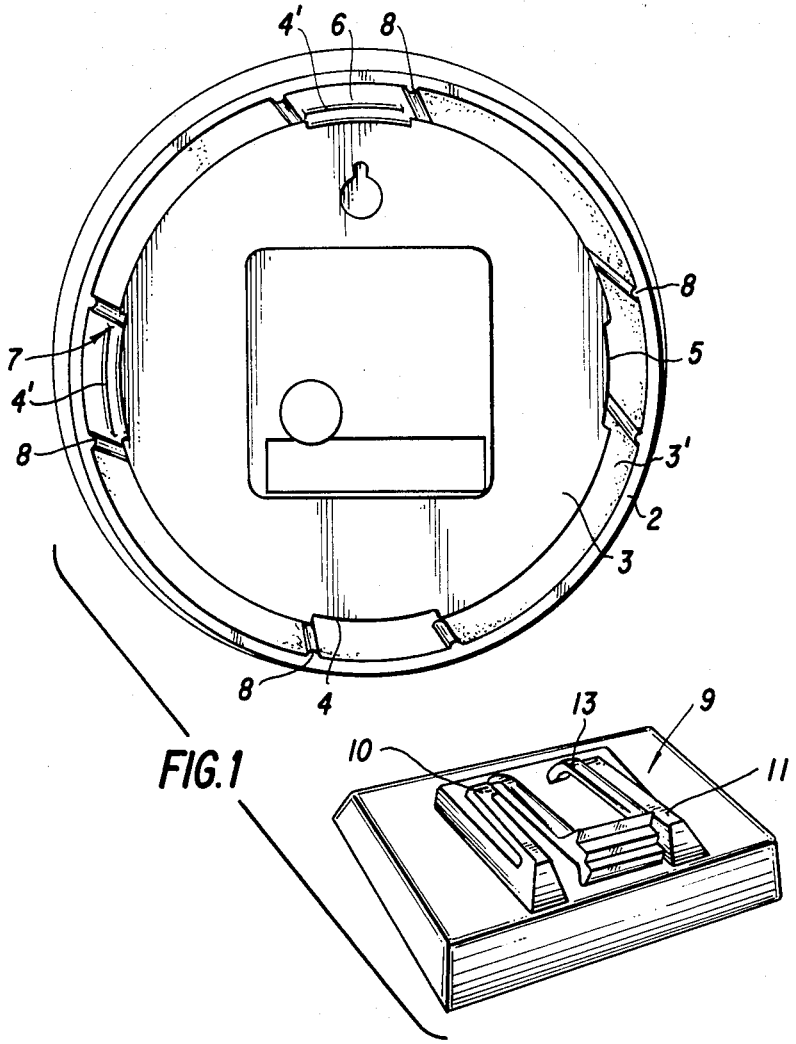
FIG. 1 shows a rear view of one embodiment of the present invention with the clock separated from the stand.

The present invention is a combination clock 1 and stand 9. As can be seen in FIG. 1, the clock includes a cylindrical clock body 3 and an outer circumferential cylinder 2 coaxially surrounding the body and being attached thereto. A channel 3' is defined between the cylinder 2 and the clock body 3.

The outer cylinder has on the inner surface thereof a plurality of axially extending pairs of spaced-apart, parallel projections 8. In the embodiment shown in FIG. 1, these projections 8 define a set of four grooves 4, 5, 6, 7 around the periphery of the clock body. Each of the grooves are provided with openings 4' extending radially inwardly between a pair of parallel projections 8. The openings are formed in the grooves and are spaced axially inwardly of the back of the clock body. The stand 9 includes a base portion having a pair of parallel elastic latches 10 thereon. Each latch has a front end and a rear end. The rear ends of the latch 10 are mounted on the base portion as clearly can be seen in FIGS. 2 and 3. The latches are spaced apart and sized to flank one of the pairs of projections 8 on the outer circumferential cylinder 2 of the clock. A pair of flexible curved pieces 13 each having a front end and a rear end are attached at its front end to the front end of one of the latches 10. Each of the curved pieces 13 and latches 10 are sized to fit slideably in the channel 3'. Multiple jaw members 11, 12 connect the rear ends of the curved pieces 13. The multiple jaw members 11, 12 are adapted to engage with one of the openings 4' and the clock body. A means 14 is provided for attaching the base portion to a desired surface. The means 14 can be an adhesive pad fixed to the bottom of the base portion.

The clock 1 and the stand 9 are assembled by inserting the latches 10 into one of the grooves 4, 5, 6, 7 into the channel 3' formed between the clock body 3 and the cylinder 2. The flexible curved pieces 13 and the latches 10 are pushed into the groove. By virtue of the flexibility of the curved pieces 13 the multiple jaws 11, 12 are fixed in the openings 4' enabling the clock and stand to be firmly combined.

Figure 2:
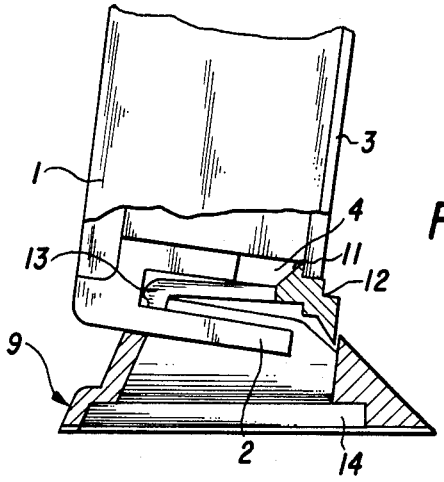
FIG. 2 shows a side, partial cross-sectional view of the present invention in a combined condition.
Figure 3:
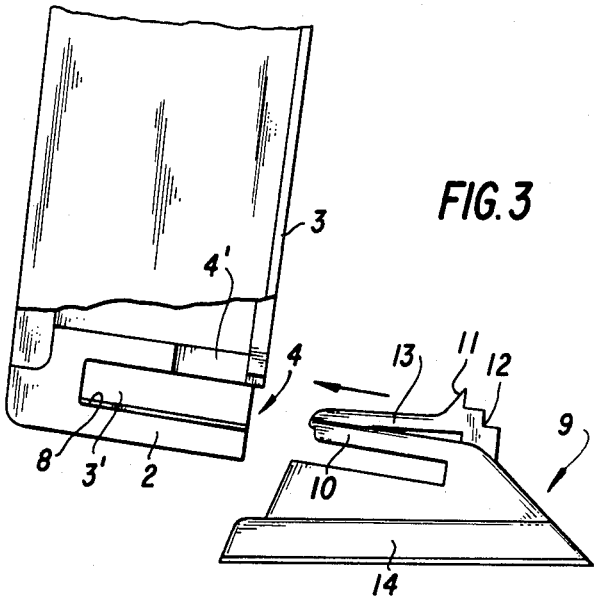
FIG. 3 shows a side, partial cross-sectional view of the present invention in a separated condition.

To separate the stand 9 from the clock 1, the multiple jaws 12 are pushed in the direction of the arrow in FIG. 2, releasing the latches 10 from the groove. In turn, the jaw 11 is freed from the opening 4'. The latches 10 of the stand 9 and the curved pieces 13 are therefore easily separated from the groove 4 of the channel 3'.

Figure 4A:
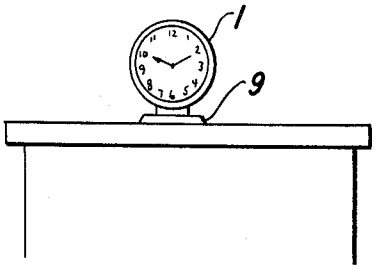
FIGS. 4A, 4B, and 4C show the present invention in use on differing surfaces.
Figure 4B:
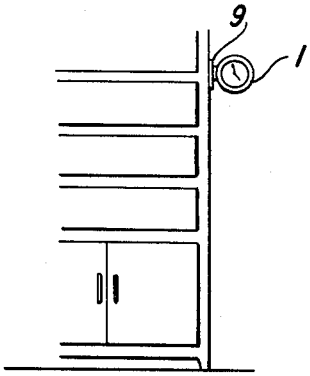
Figure 4C:
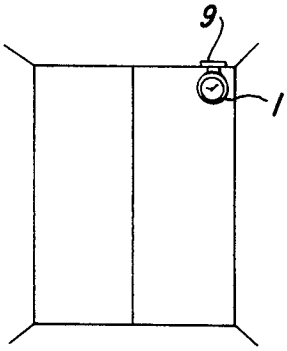

Because of the provision of multiple sets of projections 8, the clock body can be oriented relative to the stand in any desirable orientation. Consequently, as shown in FIGS. 4A, 4B and 4C, the clock and stand combination can be positioned on any horizontal or vertical surface and still have the clock remain properly oriented.

It is readily apparent that the above-described clock and stand combination meets all of the objects mentioned above and also has the advantage of wide utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A combination clock and stand comprising a clock including a cylindrical clock body, an outer circumferential cylinder coaxially surrounding and being attached to said clock body, defining a channel therebetween, said outer cylinder having on an inner surface thereof a plurality of axially extending pairs of spaced-apart parallel projections, said projections extending radially into said channel, said clock body having on an outer surface thereof a plurality of openings, each opening extending radially inwardly between one pair of said parallel projections and being spaced inwardly of the back of said clock body; and a stand including a base portion, a pair of parallel elastic latches each having a front end and rear end and being mounted at its rear end on said base portion, said latches being sized to flank one of the pairs of projections, a pair of flexible curved pieces, each having front end and a rear end and being attached at its front end to the front end of one of the latches, said curved pieces and said latches being sized to fit slideably in said channel, multiple jaw members connecting the rear ends of said curved pieces and adapted to engage with one of said openings in said clock body, and means for attaching said base portion to a desired surface.

2. The combination of claim 1, wherein said means for attaching comprises adhesive pads fixed to a bottom of said base portion.

* * * * *